United States Patent [19]

Debortoli

[11] Patent Number: 4,764,125

[45] Date of Patent: Aug. 16, 1988

[54] CABLE TERMINAL CONNECTORS

[75] Inventor: George Debortoli, Ottawa, Canada

[73] Assignee: Northern Telecom Limited, Montreal, Canada

[21] Appl. No.: 22,694

[22] Filed: Mar. 6, 1987

[30] Foreign Application Priority Data

Mar. 12, 1986 [GB] United Kingdom ..... 8606039

[51] Int. Cl.[4] ..... H01R 11/20

[52] U.S. Cl. ..... 439/403; 439/413

[58] Field of Search ..... 439/395, 399, 402, 403, 439/411–417; 174/88 R

[56] References Cited

U.S. PATENT DOCUMENTS

| | | | |
|---|---|---|---|
| 3,629,787 | 12/1971 | Wilson | 174/88 R |
| 3,804,971 | 4/1974 | Bazille, Jr. | 174/88 R |
| 3,923,362 | 12/1975 | Dunn et al. | 439/403 |
| 3,985,416 | 10/1976 | Dola et al. | 174/88 R |

*Primary Examiner*—Neil Abrams
*Attorney, Agent, or Firm*—R. J. Austin

[57] ABSTRACT

Cable terminal connector with a housing to receive conductors of one cable into terminal positions within the housing and a closure member having terminal positions for conductors of another cable. Insulation displacement contact members have an insulation displacement terminal at one end and are initially located in detent positions with the terminals spaced from the terminal positions of the housing. The closure member is movable into a fully retained position upon the housing and during this movement, the contact members are caused to move to locate their terminals into the terminal positions of the housing to connect them to the cable conductors in the housing. Conveniently, the contact members also have insulation displacement terminals at their other end for movement into the terminal positions of the closure member as the closure member moves into the fully retained position.

12 Claims, 4 Drawing Sheets

CABLE TERMINAL CONNECTORS

This invention relates to cable terminal connectors.

Terminal connectors are made in a multitude of designs and are used for various purposes for connecting cable lengths together. One type of cable terminal connector is used for making electrical connections between outside aerial cables and drop wires which extend from holes to subscriber's premises. In use of this type of cable terminal connector, it is common practice to pre-assemble the connectors onto short lengths of cable in the factory. The reason for this pre-assembly is to avoid the necessity of assembling the ends of the aerial cables into the connectors on site in the aerial locations. In fact, in at least some cases, it would be impossible to assemble the aerial cables into the terminals of the connectors.

While it may seem convenient to provide preassemblies of connectors and short cable lengths from the factories, this adds to the cost of the product and in addition a further step is required to connect the short cable lengths to the aerial cables. This additional step involves the splicing of the individual conductors of the aerial cables to the short cable lengths extending from the connectors.

The present invention seeks to provide a cable terminal connector which avoids the necessity of having to provide such splices with aerial cables while at the same time avoiding the pre-assembly of connectors onto short cable lengths.

According to one aspect of the present invention there is provided a cable terminal connector comprising an insulating housing formed with apertures for receiving conductors of a first cable into a plurality of first terminal positions for the first cable within the housing; a plurality of insulation displacement contact members each having an insulation displacement terminal at one end and also a terminal at the other end, the contact members located in a detent position by the housing and in which the insulation displacement terminals are directed towards and are spaced from the first terminal positions; a channel closure member having an insulating closure body and providing second terminal positions for conductors of a second cable to be received through apertures formed in the closure member, the closure member received upon the housing in a retracted position; means for moving the closure member from the retracted position to a fully retained position firmly secured to the housing and in which the terminals at the other ends of the contact members extend into the second terminal positions; and means cooperable between the closure member and each contact member for urging each contact member from its detent position into an operating position during movement of the closure member into its fully retained position, each contact member in the operating position having its insulation displacement terminals at said one end extending into the first terminal positions.

With the cable terminal connector according to the invention, the connector may be supplied from the factory with the closure member in the retracted position and the insulation displacement terminals in the detent position. Thus, any connector according to the invention may then be used on site to connect the ends of the aerial cable directly into the first terminal positions and during movement of the channel closure member into its fully retained position, the insulation displacement terminals are moved automatically into their fully operating positions. During this movement electrical connection is made between the conductors of the aerial cable and the insulation displacement terminals. As may be seen therefore, the assembly of the connectors to the aerial cables is a simple operation which avoids the necessity of pre-assembling connectors onto short lengths of cable and also avoids the conventional requirement of providing splices between the aerial cable and the short cable lengths.

Conveniently the contact members are formed with a non-return means which allow for their movement towards the first terminal positions while preventing their return movement. With this preferred arrangement, the contact members are held in their detent positions by the material of the housing which ensures that the contact members do not become displaced.

In a convenient arrangement of a connector according to the invention, each contact member is formed with a transverse through opening and the means for urging each contact member into its operating position comprises a rigid cross-member extending through and projecting from the opening at each side of its contact member, the closure member abutting against the cross-member so as to push the cross-member and urge the contact member into its operating position while the closure member moves towards its fully retained position. Each contact member may conveniently be received within a guide channel defined by the housing and each cross-member is received within a cross-member guide channel which extends across its contact member receiving channel.

In a further convenient arrangement the terminal at the other end of each contact member is also an insulation displacement terminal which enters into the second terminal position as the closure member moves into its fully retained position.

According to a further aspect of the present invention there is provided an assembly of cable terminal connector and aerial cable wherein the connector comprises an insulating housing formed with apertures which directly receive the conductors of the aerial cable while avoiding an external splice to electrically connect the connector to the aerial cable, the conductors of the aerial cable extending into a plurality of first terminal positions within the housing; a plurality of insulation displacement contact members each having an insulation displacement terminal at one end and also another terminal at the other end, the contact members located in the housing with the insulation displacement terminals extending to the first terminal positions and being electrically connected to the conductors of the aerial cable; a closure member having an insulating closure body and providing second terminal positions at which said other terminals are electrically connected to conductors of another cable, the closure member received upon the housing in a fully retained position firmly secured to the housing; and means cooperable between the closure member and each contact member by which the closure member exerts pressure upon each contact member to hold it in position with its insulation displacement terminal extending into the first terminal position.

Embodiments of the invention will now be described, by way of example, with reference to the accompanying drawings, in which.

Figure 1:
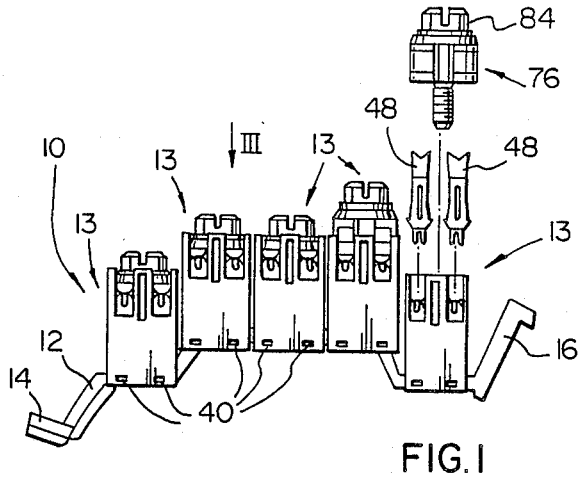
FIG. 1 is a side elevational view of a cable terminal connector assembly comprising a plurality of connectors according to a first embodiment.
Figure 2:
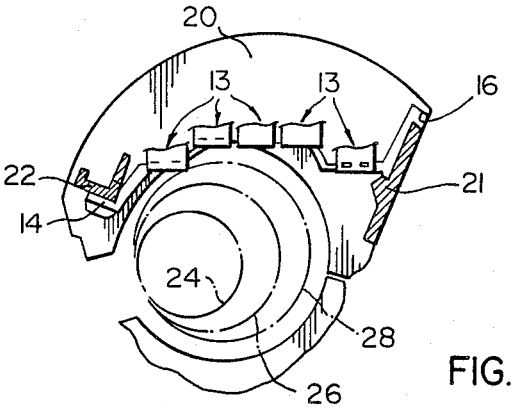
FIG. 2 is a similar view of the assembly of FIG. 1 and on a smaller scale, showing it assembled into a terminal housing as used for aerial terminations.

As shown in FIGS. 1 and 2, a cable connector assembly 10 comprises a mount 12 carrying a plurality (namely five) cable terminal connectors located side-by-side in the mount. The mount may take any desirable shape, such as straight. However, in this embodiment, the mount is of a more contorted or complex shape, as shown in FIG. 1, to fit the terminal of FIG. 2. The mount is of elongate formation and has integral formed extensions 14 and 16 at its ends for attachment to an aerial terminal. As shown in FIG. 2, the aerial terminal has a framework 20, and the projection 16 at one end of the mount 12, extends through the framework and is positioned on a frame member 21. At the other end of the connector, the projection 14 abuts a further frame member 22 and is attached thereto as by screws (not shown). Chain dotted circles 24, 26 and 28 illustrate the diameter of different sizes of cables that can be accommodated in the terminal.

Figure 4:
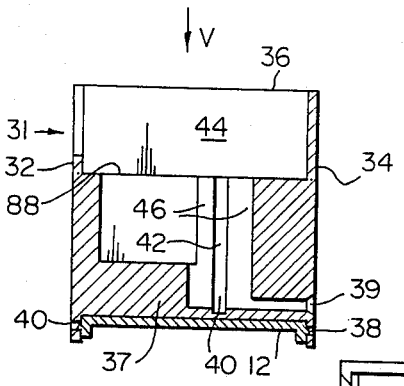
FIG. 4 is a cross-sectional view taken along line IV—IV in FIG. 3, to a larger scale and showing an insulating housing of a connector of the assembly.

All of the connectors 13 are of similar construction. Each connector 13 comprises an insulating housing 31 which has front and rear walls 32 and 34 and side walls 36. The housing is attached to the mount by locking projections 38 in the mount detachably mounted through holes 40 in the lower ends of walls 32 and 34 (FIG. 4). The connector is formed at a base 37 with two apertures 39 (see particularly FIG. 4), for reception of two conductors (to be described) of an aerial cable to be inserted into the housing for reception of the conductor ends into first terminal positions 40 within the housing.

Figure 3:
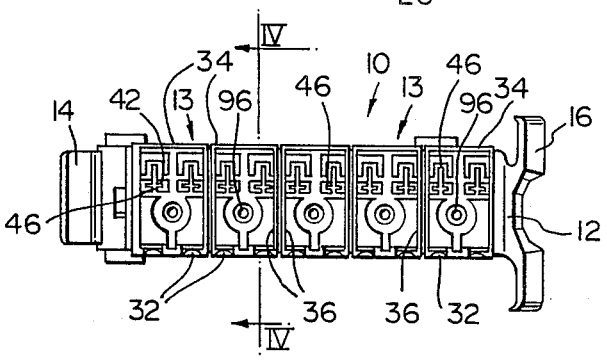
FIG. 3 is a plan view of the connector assembly in the direction of arrow III in FIG. 1 having closure members of connectors removed to show inside detail of connector housings.
Figure 5:
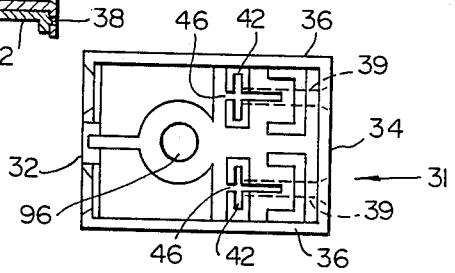
FIG. 5 is a plan view of the insulating housing in the direction of arrow V in FIG. 4.

As shown by FIGS. 3 and 5, each connector is open at a top side and a guide channel 42 is interconnected with each respective aperture 39 and extends upwardly through the base 37 so as to open at the upper surface 88 of the base into a chamber 44 defined between the walls 32, 34 and 36. Each channel 42 is for guiding an insulation displacement contact member 48 (FIG. 6) down into a terminal position 40. Each channel 42 forms one cross-leg of a cruciform-shaped channel (see FIG. 5), the other cross-leg 46 of which extends across the channel 42 at right angles to it.

Figure 6:
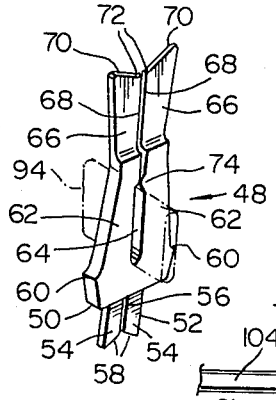
FIG. 6 is an isometric view of an insulation displacement contact member used in a connector and to a larger scale.

As shown by FIG. 6, each insulation displacement contact member is formed from conductive metal in the form of a generally flat strip. It has a base 50 at one end and from which depends an insulation displacement terminal 52 comprising two spaced legs 54. The legs have opposed inner edges 56 and upwardly and inwardly inclined lower edges 58. The two legs are resiliently movable apart for the purpose of gripping a conductor of a cable held therein. Also, the junction between the edges 58 and the inner edges 56 of the legs provides a cutting edge for severing insulation from a conductor as it is moved upwardly between the legs during the making of an electrical connection with the contact member by a cable.

At each edge of the base 50, each contact member is formed with a non-return means which allows for its movement in one direction along its channel 42, i.e. in the direction of terminal 40, but not in the other direction. At each edge of the base, this non-return means is in the form of a barb 60 which extends from the edge of the base.

Above the base 50, each contact member is bifurcated and has two legs 62 spaced apart by a slot 64 which extends vertically upwards part way towards the top of the contact member. The legs 62 terminate at their upper ends in thinner portions 66 which provide an upper terminal which is also an insulation displacement terminal. Opposed edges 68 of the upper end 66 of the legs are for gripping a conductor of a drop wire to be inserted into the connector. At the upper ends of the legs are provided two downward and inward inclined surfaces 70 which terminate in cutting edges 72 which extend for the full thickness of the upper leg portion 66 and form a junction between the sloping upper end 70 and the confronting edges 68. One of the legs 62 is swaged at its inner edge at 74 directly above the slot 64 so as to preload the upper insulation displacement terminal, i.e. by springing the upper ends 66 a small distance apart beyond their normal position.

Each connector 13 also comprises a closure member 76 (FIGS. 1, and 7 to 10). This closure member comprises an insulating closure body 78 formed from a plastics molding and the body is slidable vertically between the opposing walls 32 and 34 by upwardly and outwardly tapering non-return projections 80 molded at opposite sides of the body 78, the projections vertically slidably received within vertical slots 82 formed in the housing walls 32 and 34. As can be seen from the figures, the projections 80 have horizontal upper surfaces which resist the removal of the closure member without deformation of the walls of the housing.

Figure 7:
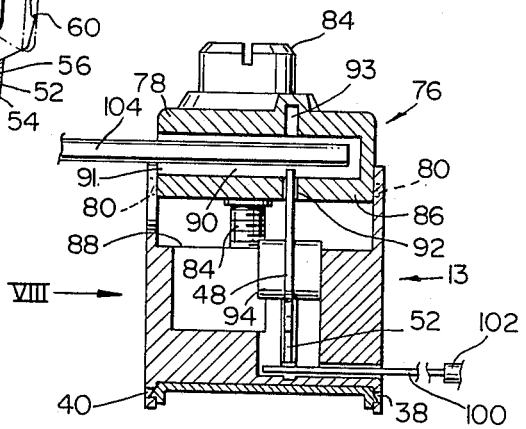
FIG. 7 is a view similar to and on the scale of FIG. 4, showing a complete connector with a closure member in a retracted position.
Figure 8:
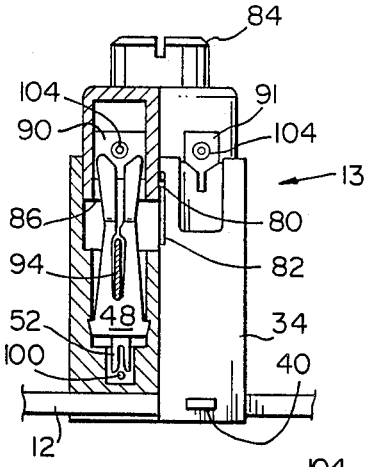
FIG. 8 is a view of the connector partly in the direction of arrow VIII in FIG. 7 and partly in section.

Each closure member 76 is movable vertically downwards from a retracted position, such as shown in FIGS. 7 and 8, into a fully retained position within the housing 31 and for this purpose the closure member is provided with a means to provide such movement. This means is in the form of a male screw-threaded member or screw 84 which is rotatably captive through the body 78 of the closure member. A base wall 86 of the body 78 extends horizontally so as to face the upper surface 88 of the base 37 of the housing in each connector. The body 78 of the closure member is provided with two passages 90 which extend horizontally above the wall 86, the passages having openings 91 for the purpose of receiving insulated conductors of a drop wire to be connected to the upper insulation displacement terminals of the contact members 48 forming part of the connector. The wall 86 is formed with two vertical apertures 92 aligned with the guide channels 42 for receiving the upper ends of the contact members 48 into the passages 90. The upper part of the body 78 is also formed with blind recesses 93 into which the upper ends of the upper displacement terminals pass with the closure member in its fully retained position.

Each connector is also provided with a means cooperable between the closure member and with each contact member for urging the contact member from a detent position (to be described) into an operating position as the closure member is moved into its fully retained position. This urging means comprises a rigid flat member 94 which is slidable through the slot 64 between the legs 62 of its contact member to occupy the position shown in chain-dotted outline in FIG. 6. The block 94 is of dimensions to be slidably received within the channel 46.

The connector assembly 10 is made and supplied to cable installers without any cable or conductors assembled to the connector assembly. Each of the connectors 13 has its two contact members 48 disposed in a detent position as shown in FIGS. 7 and 8. In this position of the contact members 48, each lower insulation displacement terminal 52 is spaced above, but directed towards the lower terminal positions 40. The contact members are assembled into their guide passages 42 as a push fit so that the contact members are retained in this position before use. The projections 60 prevent the contact members from returning out of the guide channel by being gripped by the plastics material of the housing 31. Also, as can be seen from FIGS. 7 and 8, the blocks 94 are received partially in their channels 46 and project upwardly above the upper surfaces 37 of the connectors. The closure members are connected to the housing 12 by reception of the screws 84 within correspondingly screwed holes 96 formed in the bases 37 of the housings (see FIG. 5). The closure members are spaced above the bases 37 in their retracted positions so that the upper insulation displacement terminals on the contact members project slightly through the apertures 92 towards the passages 90. In the retracted position for each closure member, the projections 80 are received in upper ends of the slots 82 of the walls 32 and 34.

Figure 9:
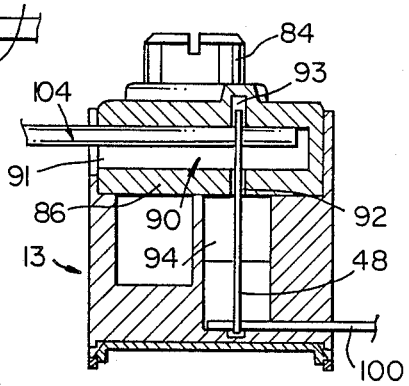
FIGS. 9 and 10 are views similar, respectively, to FIGS. 7 and 8 and showing the closure member in a fully retained position.
Figure 10:
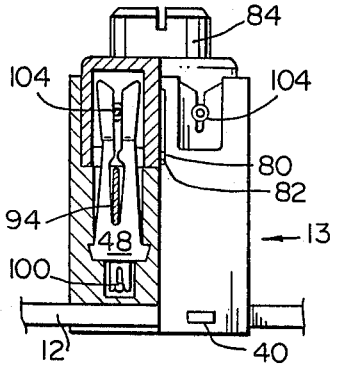
Figure 11:
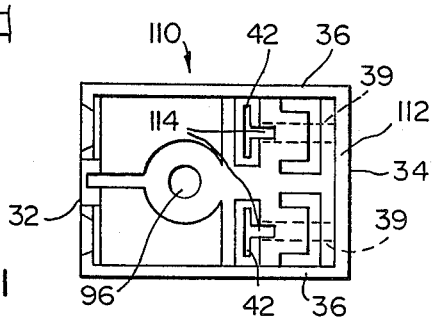
FIG. 11 is a view similar to FIG. 5 of a housing of a connector of a second embodiment.

In use of the connector assembly described above, the assembly is located within the framework 20 of the aerial terminal. To connect conductors of an aerial cable to a drop wire through one of the connectors 13, as shown in FIG. 7, two insulated conductors 100 of the cable 102 are passed through the apertures 39 of the connector. Two conductors 104 of the drop wire are passed through the passages 90 and over the top of the corresponding members 48. The closure member is then moved from its retracted into its fully retained position by operation of the screw 84 to move the closure member downwardly. As the closure member moves down, the wall 86 approaches and finally comes into contact with the two blocks 94 of the connector. Continued downward movement of the closure member forces the blocks 94 against the lower end surfaces of slots 64 which provide thrust surfaces of the contact members. This results in the downward movement of both the blocks and of the contact members 48 thereby moving the lower insulation displacement terminals towards the insulated conductors in the terminals 40. As the insulation displacement terminals 52 enter the terminal positions 40, the insulation surrounding each conductor 100 engages one or other of the sloping end surfaces 58 of its terminal and is guided towards the space between the edges 56. As the conductors pass between the edges 56, the insulation surrounding the conductors is stripped away automatically by the cutting edges provided between the sloping edges 58 and the edges 56 so that the conductors move upwardly between the edges 56 in electrical engagement with the legs 54. In the final position of the contact members 48, the conductors 100 are retained permanently electrically connected into the lower insulation displacement terminals as shown by FIGS. 9 and 10. In this position, the terminals 52 are spaced slightly from adjacent ends of the associated guide channels.

Also, during the downward movement of the closure member 76, the upper insulation displacement terminals of the contact members contact the conductors so as to strip surrounding insulation material from the conductors upon the cutting edges 72 and force the conductors between the opposed edges 68 of the legs 66. This action is preferred as the legs 66 enter the blind bore 93 with the drop wire conductors held against the upper wall 104 of the passage 90 as shown in FIG. 9. As can be seen from FIG. 10, in the fully retained position of the closure member 76, the drop wire conductors are also permanently in electrical connection with the upper insulation displacement terminals.

As may be seen from the above description, connectors as described in the embodiment and according to the invention are easily usable on site and conductors from both an aerial cable and from a drop wire are easily connected into terminals of the connector by a cable installer. In addition to this, the connections of both cables are formed at the same time by the simple operation of moving the closure member into its fully retained position thereby avoiding the time and trouble required to sequentially connect the conductors of the two cables. While the construction described in the embodiment and according to the invention is easily usable without the requirement for short lengths of cable being pre-assembled to a connector, the use of the connectors described avoids the necessity for a splice to connect an aerial cable into such short lengths of cable.

In a second embodiment shown in FIGS. 11, 12, 13 and 14 each connector 110 for use in an assembly of connectors, comprises an insulating housing 112 which is similar in design to that of the first embodiment except that the cruciform-shaped channel arrangements 42, 46 of the first embodiment are replaced by 'T'-shaped slots with the head channel 42 of the 'T' for acceptance of an associated contact member 48. The leg 114 of each slot extends towards rear wall 34.

Figure 12:
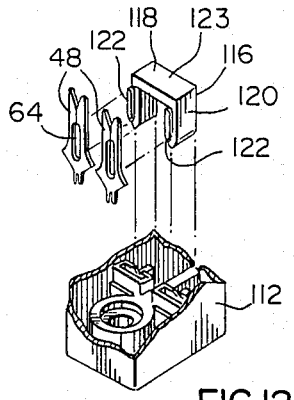
FIG. 12 is an isometric exploded view of part of the connector of the second embodiment and showing a part only of the housing.
Figure 13:
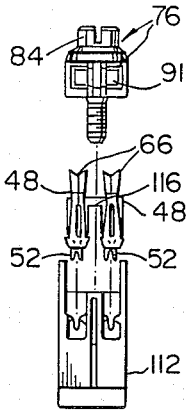
FIG. 13 is an exploded front view of the connector of the second embodiment.

Means for urging the two contact members 48 into their fully operating positions comprises an inverted U-shaped member 116 (FIG. 12). This has a base 118 with downward legs 120, each having a forward protrusion 122 which is accepted into a slot 64 of a contact member 48.

Figure 14:
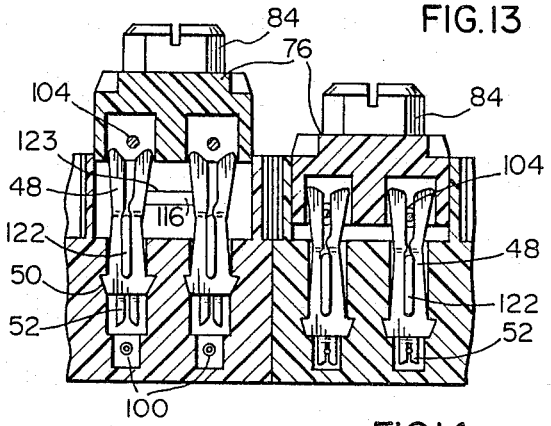
FIG. 14 is a cross-sectional view through two side-by-side connectors showing the parts in different assembly positions.

Upon initial assembly of the connector, the contact members 48 are in their detent positions as shown at the left-hand side of FIG. 14. In this position, the closure member 76 is in its upper retracted position and lies spaced from the upper surface 123 of the member 116. As the closure member is moved towards and into the fully retained position by screw 84, it approaches the member 116 and thus the contact members 48. During this downward movement, the drop wires 104 are caused to approach the upper terminals, until these wires move between opposed edges 68 of the legs 62 to displace the wire insulation and cause electrical contact with the legs 62 as described in the first embodiment. This relationship of wires 104 and the contact members 48 is shown on the top right-hand side of FIG. 14. After the closure member engages the upper surface 123 of the member 116, its continued downward movement causes downward movement of the contact members 48 through the U-shaped member 116 to bring the members 48 into their operating positions in which the insulation displacement terminals 52 are electrically connected to the insulated conductors 100. This is shown at the right-hand side of FIG. 14.

Figure 15:
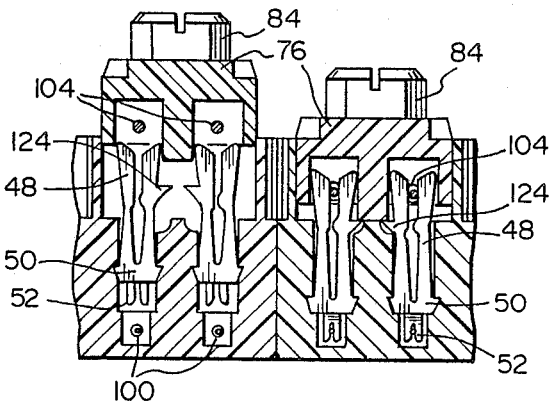
FIG. 15 is a view similar to FIG. 14 of a third embodiment.

In a third embodiment, shown in FIG. 15, the means for urging the contact members 48 downwards comprises a lateral extension or tang 124 formed on each member 48. This tang is approached and its upper or thrust surface is contacted by the undersurface of the closure member 76 to move the contact members 48 from their detent positions into their operating positions as shown from the left-hand side to the right-hand side of FIG. 15.

What is claimed is:

1. A cable terminal connector comprising an insulating housing formed with apertures for receiving conductors of a first cable into a plurality of first terminal positions for the first cable within the housing;

a plurality of elongate insulation displacement contact members each having an insulation displacement terminal at one end and also having another terminal at the other end, the contact members located in detent positions within guide channels defined by the housing, the guide channels extending lengthwise of the contact members, and the insulation displacement terminals being directed in the lengthwise direction of the contact members towards and being spaced from the first terminal positions;

a closure member having an insulating closure body and providing second terminal positions for conductors of a second cable to be received through apertures formed in the closure member, the closure member received upon the housing in a retracted position;

means for moving the closure member in a lengthwise direction of the contact members from the retracted position to a fully retained position firmly secured to the housing and in which the terminal at said other end of each contaact member extends into a corresponding second terminal position; and means cooperable between the closure member and each contact member for urging each contact member in said lengthwise direction from its detent position into an operating position during movement of the closure member into its fully retained position, said urging means comprising a thrust surface provided on each contact member in a position in said lengthwise direction, intermediate the terminals and against which a load is applied during movement of the closure member into its fully retained position to move the contact member into its operating position, each contact member in the operating position having its insulation displacement terminal at said one end extending into one of the first terminal positions and being spaced at the one end, in the lengthwise direction of the contact members, from an adjacent end of the associated guide channel.

2. A connector according to claim 1 wherein the contact members are provided with non-return means which allow for movement of the contact members from the detent positions towards the first terminal positions while preventing movement in the opposite direction.

3. A connector according to claim 1 wherein the means for moving the closure member comprises a male screw threaded member forming part of the closure and received in screw threaded engagement with a complementary screw threaded hole in the housing.

4. A connector according to claim 1 wherein the terminal at the other end of each contact member is also an insulation displacement terminal which moves into its second terminal position as the closure member moves towards its fully retained position.

5. An assembly of cable terminal connector and aerial cable wherein the connector comprises an insulating housing formed with apertures which directly receive the conductors of the aerial cable while avoiding an external splice to electrically connect the connector to the aerial cable, the conductors of the aerial cable extending into a plurality of first terminal positions within the housing;

a plurality of elongate insulation displacement contact members each having an insulation displacement terminal at one end and also having another terminal at the other end, the contact members located within guide channels defined in the housing, the guide channels extending lengthwise of the contact members, with the insulation displacement terminals extending to the first terminal positions, being electrically connected to the conductors of the aerial cable, and being spaced at their ends in the lengthwise direction of the contact members from adjacent ends of the associated guide channels;

a closure member having an insulating closure body and providing second terminal positions at which said other terminals are electrically connected to conductors of another cable, the closure member received upon the housing in a fully retained position firmly secured to the housing; and means cooperable between the closure member and each contact member, said means comprising a thrust surface provided upon each contact member in a position, in the lengthwise direction of the contact member, intermediate the terminals and against which the closure member exerts pressure upon each contact member to hold it in position with its insulation displacement terminal extending into the first terminal position.

6. A cable terminal connector comprising an insulating housing formed with apertures for receiving conductors of a first cable into a plurality of first terminal positions for the first cable within the housing;

a plurality of elongate insulation displacement contact members each having an insulation displacement terminal at one end and also having another terminal at the other end and a transverse through opening disposed intermediate the terminals, the contact members located in detent positions within guide channels defined by the housing, the guide channels extending in a direction lengthwise of the contact members, and the insulation displacement terminals being directed in said lengthwise direction towards and being spaced from the first terminal positions;

a closure member having an insulating closure body and providing second terminal positions for conductors of a second cable to be received through apertures formed in the closure member, the closure member received upon the housing in a retracted position;

means for moving the closure member, in the lengthwise direction of the contact members, from the retracted position to a fully retained position firmly secured to the housing and in which the terminal at said other end of each contact member extends into a corresponding second terminal position; and means cooperable between the closure member and each contact member for urging each contact member in its lengthwise direction from its detent position into an operating position during movement of the closure member into its fully retained position, said urging means for each contact member comprising a rigid cross-member extending through and projecting from the opening at each side of its contact member, the closure member abutting against the cross-member so as to push the cross-member and urge the contact member into its operating position while the closure member moves towards its fully retained position, each contact member in the operating position having its insulation displacement terminal at said one end extending into one of the first terminal positions and being spaced at the one end, in the lengthwise direction of the contact members, from an adjacent end of the associated guide channel.

7. A connector according to claim 6 wherein each cross-member is received within a cross-member guide channel defined by the housing, the cross-member guide channel and the associated contact member guide channel extending one across the other.

8. A connector according to claim 6 wherein the means for moving the closure member comprises a male screw threaded member forming part of the closure and received in screw threaded engagement with a complementary screw threaded hole in the housing.

9. A connector according to claim 6 wherein the terminal at the other end of each contact member is also an insulation displacement terminal which moves into its second terminal position as the closure member moves towards its fully retained position.

10. A cable terminal connector comprising an insulating housing formed with apertures for receiving conductors of a first cable into a plurality of first terminal positions for the first cable within the housing;

a plurality of elongate insulation displacement contact members each having an insulation displacement terminal at one end and also having another terminal at the other end, the contact members located in detent positions within guide channels defined by the housing, the guide channels extending in a lengthwise direction of the contact members and the insulation displacement terminals being directed in said lengthwise direction towards and being spaced from the first terminal positions;

a closure member having an insulating closure body and providing second terminal positions for conductors of a second cable to be received through apertures formed in the closure member, the closure member received upon the housing in a retracted position;

means for moving the closure member, in the lengthwise direction of the contact members, from the retracted position to a fully retained position firmly secured to the housing and in which the terminal at said other end of each contact member extends into a corresponding second terminal position; and means cooperable between the closure member and each contact member for urging each contact member in its lengthwise direction from its detent position into an operating position during movement of the closure member into its fully retained position, said urging means comprising a lateral extension on each contact member in a position, in said lengthwise direction, intermediate the terminals, the closure member operable to apply a load against the lateral extension during movement of the closure member into its fully retained position to move the contact member into its operating position, each contact member in the operating position having its insulation displacement terminal at said one end extending into one of the first terminal positions and being spaced at the one end, in the lengthwise direction of the contact members, from an adjacent end of the associated guide channel.

11. A connector according to claim 10 wherein the means for moving the closure member comprises a male screw threaded member forming part of the closure and received in screw threaded engagement with a complementary screw threaded hole in the housing.

12. A connector according to claim 10 wherein the terminal at the other end of each contact member is also an insulation displacement terminal which moves into its second terminal position as the closure member moves towards its fully retained position.

* * * * *